US006318043B1

(12) United States Patent
Johnson

(10) Patent No.: US 6,318,043 B1
(45) Date of Patent: Nov. 20, 2001

(54) SHELTER AND SHELTER SUPPORT MEMBERS

(76) Inventor: Steve Johnson, 4426 Clifford Ave., Cincinnati, OH (US) 45236

( * ) Notice: Subject to any disclaimer, the term of this patent is extended or adjusted under 35 U.S.C. 154(b) by 0 days.

(21) Appl. No.: 09/660,132

(22) Filed: Sep. 12, 2000

(51) Int. Cl.[7] ..... E04B 1/32

(52) U.S. Cl. ..... 52/639; 52/644; 52/643; 52/82; 52/81.1; 52/81.2; 52/640

(58) Field of Search ..... 52/639, 644, 643, 52/82, 81.1, 81.2, 693, 640

(56) References Cited

U.S. PATENT DOCUMENTS

| | | | | |
|---|---|---|---|---|
| D. 255,158 | | 5/1980 | Hanaford . | |
| D. 299,959 | | 2/1989 | Montgomery . | |
| D. 305,070 | | 12/1989 | Dalton . | |
| D. 306,761 | | 3/1990 | Caraco . | |
| D. 364,232 | | 11/1995 | Siebelink . | |
| D. 369,638 | | 5/1996 | Smith . | |
| D. 378,137 | | 2/1997 | Gregoire . | |
| D. 395,518 | | 6/1998 | Matchey . | |
| D. 402,376 | | 12/1998 | St. Gelais et al. . | |
| D. 411,309 | | 6/1999 | St. Gelais et al. . | |
| D. 414,274 | | 9/1999 | Rehmert et al. . | |
| D. 418,921 | | 1/2000 | Wilkie . | |
| 1,387,698 | | 8/1921 | Erickson . | |
| 1,800,988 | | 4/1931 | Ewing . | |
| 3,343,321 | | 9/1967 | Axelsson . | |
| 3,501,876 | | 3/1970 | Engle . | |
| 3,683,427 | | 8/1972 | Burkholz et al. . | |
| 3,908,329 | * | 9/1975 | Walter | 52/248 |
| 4,041,659 | * | 8/1977 | McElhoe | 52/93 |
| 4,074,682 | | 2/1978 | Yoon . | |
| 4,129,139 | | 12/1978 | Powers . | |
| 4,244,384 | | 1/1981 | Bean . | |
| 4,376,362 | * | 3/1983 | Jackson | 52/639 |
| 4,426,814 | | 1/1984 | Stuhmer . | |
| 4,483,117 | | 11/1984 | Underhill et al. . | |
| 4,592,671 | | 6/1986 | Daum . | |
| 4,733,508 | | 3/1988 | Greenblatt . | |
| 4,739,594 | | 4/1988 | Langford et al. . | |
| 4,854,104 | | 8/1989 | Pomento . | |
| 4,894,964 | | 1/1990 | Thrift et al. . | |
| 5,159,792 | | 11/1992 | Pomento . | |
| 5,197,241 | | 3/1993 | Romeo et al. . | |
| 5,806,547 | | 9/1998 | Derlinga . | |

OTHER PUBLICATIONS

"*Clamshell Buildings Relocatable Tension Fabric Structures*", http://www.clamshell.com/ Mar. 1, 2001 (Downloaded Jun. 20, 2001).

"*Sprung Instant Structures*", http://www.sprung.com/ (Downloaded Jun. 20, 2001).

* cited by examiner

*Primary Examiner*—Beth A. Stephan
*Assistant Examiner*—Chi Nguyen
(74) *Attorney, Agent, or Firm*—Wood, Herron & Evans, LLP

(57) ABSTRACT

A shelter may be readily assembled or disassembled from a plurality of identical shelter supports. Each shelter support is formed from an outer beam placed in a divergent relationship to an inner beam. The converging ends of each beam are capped by a first end member. The diverging ends of each beam are capped by a second end member. The second end member forms an acute angle with the horizontal when the first end member is placed on the ground. Thus, with the first shelter support placed as a column support the second end member is presented for engaging a second end member of a second shelter as a roof support. The truss thus formed from the two shelter supports is joined at an apex portion with other similar trusses in various arrangements conveniently to form shelters of different shapes which can be readily assembled and disassembled.

19 Claims, 4 Drawing Sheets

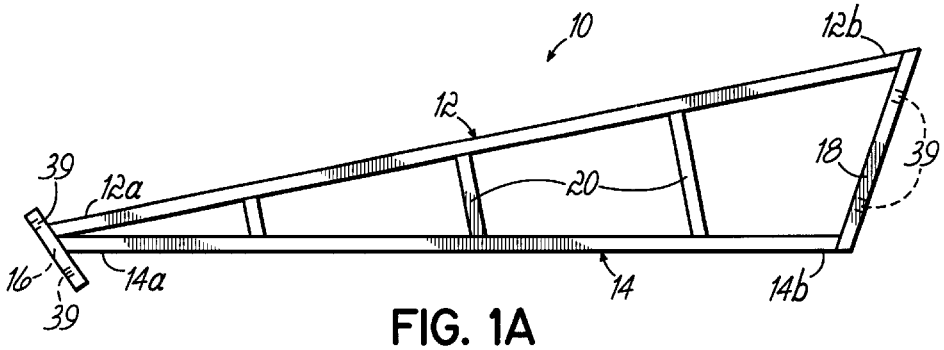
FIG. 1A
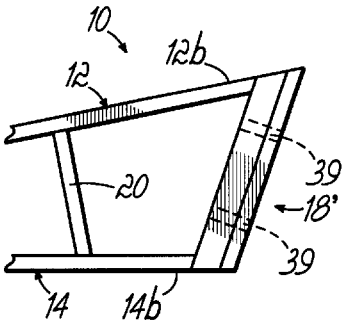
FIG. 1B
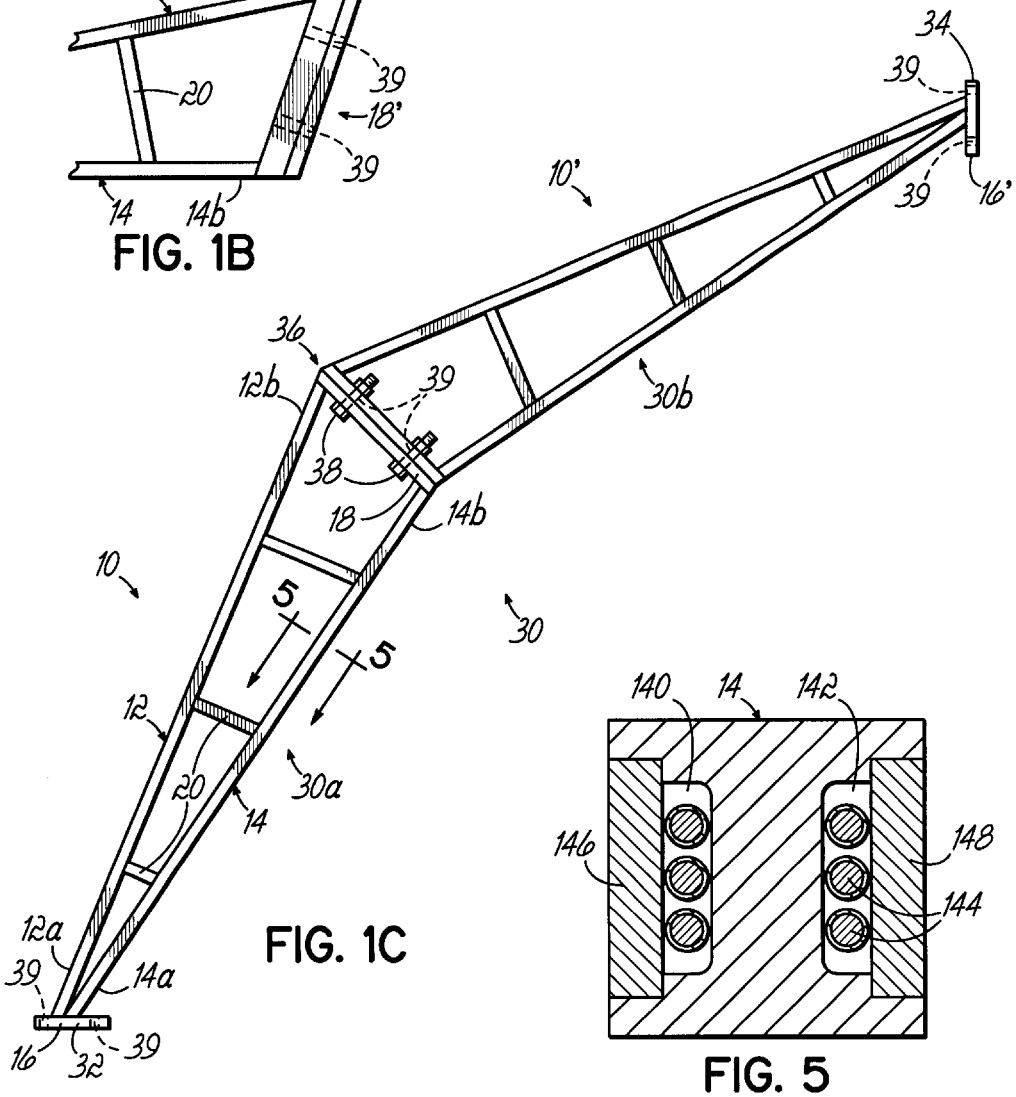
FIG. 1C
FIG. 5

SHELTER AND SHELTER SUPPORT MEMBERS

FIELD OF THE INVENTION

The invention is generally related to building structures. In particular, this invention pertains to readily assembled and disassembled modular shelters and shelter supports and associated trusses.

BACKGROUND OF THE INVENTION

Construction of buildings generally requires expertise in the on-site assembly of the load-bearing structure, or frame, of the building. Combinations of vertical pilasters and horizontal roof trusses generally form this frame for receiving wall and roof coverings.

A wide range exists in the designs, dimensions and load bearing requirements for building frames. These differences occur from building design to building design and also for particular structural members within one building design. In addition, structural members, such as a horizontal roof trusses, tend to be too large in many instances to be transported to the building site preassembled. Consequently, it is generally not practical to have pre-assembled structural members for building frames, especially not of standardized construction and design.

Similarly, placement of utilities, like electrical power, lighting, water, and wiring for telecommunication and entertainment systems, also vary greatly. Consequently, additional expertise is required for electricians and plumbers to incorporate these utilities into the building structure at an appropriate phase in the construction.

By contrast, portable structures such as camping tents and special occasion pavilions use sets of shelter supports that are readily erected by individuals having minimal expertise in building construction. Generally, easily assembled portable tents are limited to small dimensions as well as being limited in their load-bearing capacity. Furthermore, these portable structures lack provisions for utilities such as electrical wiring, relying instead upon portable powered devices.

Between the extremes of large permanent buildings and small, portable structures, there are a number of types of shelters. Examples of shelters includes enclosed residential porches, attached greenhouses, gazebos, and picnic shelters. Conventional shelters suffer from a number of disadvantages if assembled in a fashion similar to permanent buildings or portable structures.

The relatively complex assembly of structural supports for large permanent buildings requires carpentry, concrete, architectural and related expertise as well as a significant number of specialized tools and building materials of various dimensions. Often, these shelters are desired by home owners and businesses who lack these requisite tools and expertise. Moreover, the relatively small size of such projects makes them economically unattractive to builders. Consequently, the home owners and businesses may have to pay a relatively high price to have a shelter assembled.

Often, it would be desirable to have the ease, convenience and expedience of assembly and disassembly of portable tents. However, shelters often require greater structural integrity to withstand weather extremes or to be of larger dimensions than conventional tents. Furthermore, shelters, such as gazebos, often benefit from the aesthetics of a more permanent appearance.

Consequently, a significant need exists for a shelter that lends itself to be readily assembled and disassembled with a minimum of expertise and tools, yet provides sufficient structural integrity, utility and aesthetics for long-term and/or varied use.

SUMMARY OF THE INVENTION

The invention addresses these and other problems associated with the prior art by providing an apparatus and method of forming a shelter from a number of shelter supports configured to be interchangeably used as both a column support (or pilaster) and roof support. In one particular embodiment of this invention, two identical shelter supports form a truss that may be readily assembled with other trusses into a frame for a shelters of various shapes and uses and then readily disassembled.

In one embodiment of the invention, a shelter support includes divergently spaced inner and outer beams that are capped at their convergent ends by a first end member and at their divergent ends by a second end member. The second end member of the shelter support forms an acute angle with the first end supporting the shelter support so that a truss is formed by engagement of the second member to a second end member of a second shelter support.

In another aspect consistent with the invention, a plurality of trusses form a shelter, each truss in outward alignment to support an apex portion of the shelter. The apex portion is formed by coupling the first end members of a number of trusses together.

The shelter supports are advantageously utilized as the basic building component to form a wide variety of building structures, gazebos, shelters and the like. The truss formed by joining two support members together, one as a column support, pilaster or ground engaging leg and another as a roof support, can be conveniently and easily assembled and disassembled with other similar trusses to form temporary or more permanent structures for a wide variety of leisure, commercial, business, residential and/or emergency on-site structures. Further, since the shelter support is the basic component, the need for a large inventory of building components is avoided while still offering flexibility and variety for many types of structures.

These and other advantages and features, which characterize the invention, are set forth in the claims annexed hereto and forming a further part hereof. However, for a better understanding of the invention, and of the advantages and objectives attained through its use, reference should be made to the Drawings, and to the accompanying descriptive matter, in which there is described exemplary embodiments of the invention.

BRIEF DESCRIPTION OF THE DRAWINGS

FIG. 1A is a side view of a shelter support consistent with aspects of the invention.

FIG. 1B is a detail view of a reinforced divergent end of the shelter support of FIG. 1A.

FIG. 1C is a side view of a shelter truss assembled from two shelter supports of FIG. 1A.

FIG. 4 is an overhead plan view of a shelter formed from four shelter trusses of FIG. 1C attached to a building or the like.

FIG. 5 is a cross section about line 5—5 of an inner beam of the shelter support of FIG. 1A, depicting utility conduits.

DETAILED DESCRIPTION

Figure 2:
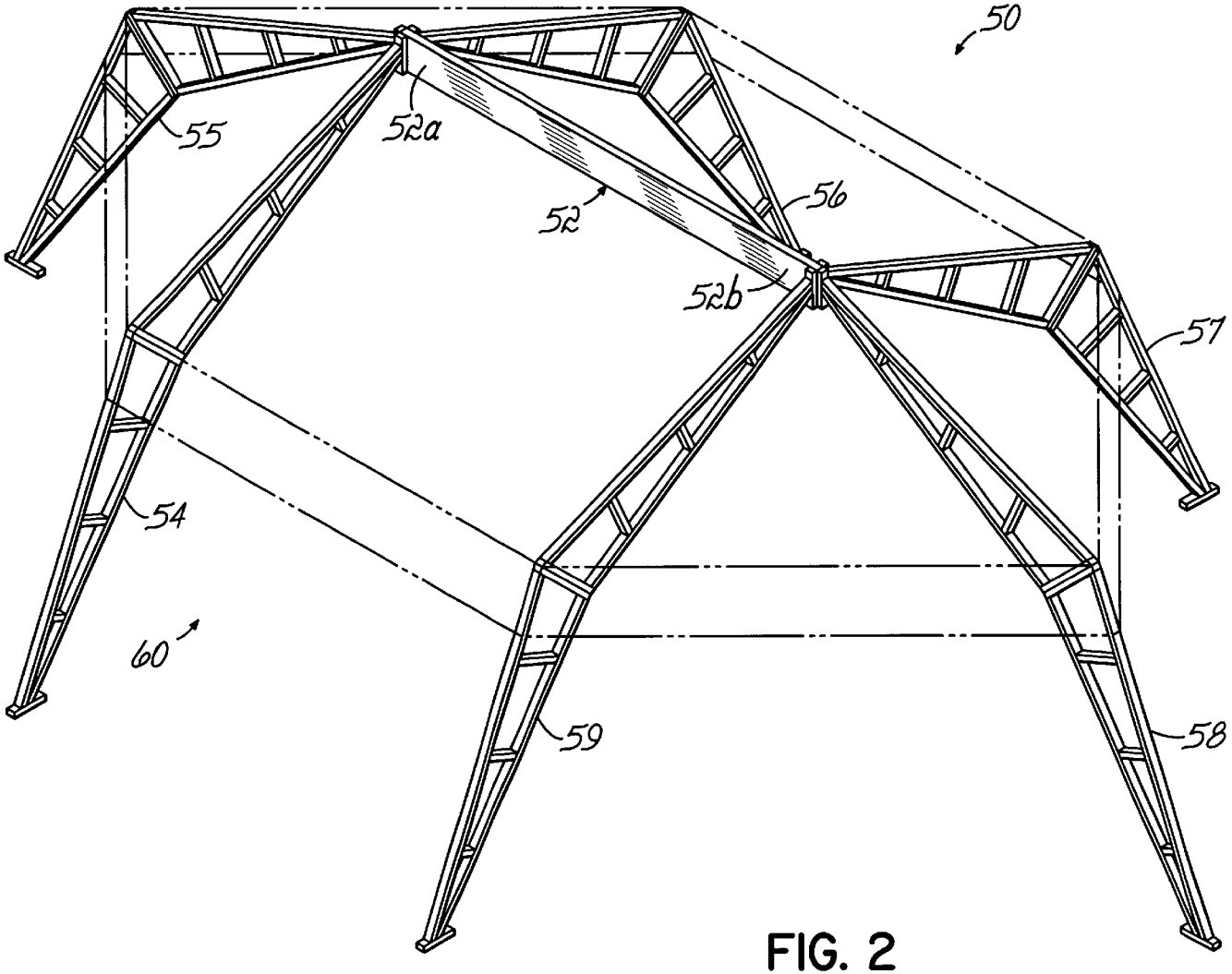
FIG. 2 is a perspective view of a first shelter formed from a number of shelter trusses of FIG. 1C arrayed about each end of a central horizontal beam.

Turning to the Drawings, wherein like numbers denote like parts throughout the several views, FIG. 1A depicts, consistent with aspects of the invention, a shelter support 10. An elongate outer beam 12 is placed in an angularly divergent relationship to an elongate inner beam 14. The closely spaced or adjacent (converging) ends 12*a,* 14*a* of the beams 12, 14 are capped by a first end member 16. The separated, diverging ends 12*b,* 14*b* of the beams 12, 14 are capped by a second end member 18. Advantageously, a number of lateral supports 20 are coupled at intervals between the beams 12, 14 to strengthen the shelter support 10.

Various attachments of the beams 12, 14 to the end members 16, 18 may used to achieve desired strength and rigidity. For instance, the diverging ends 12*b,* 14*b* of beams 12, 14 may have tenon cut ends that are received by mortise cut slots in the second end member 18 for enhanced strength for the end cut angles. Referring to FIG. 1B, the shelter support 10 may include a second reinforcing end member 18 and thereby have two layers for additional rigidity.

Referring to FIG. 1C, a shelter truss 30 is assembled from two identical shelter supports 10, 10' of FIG.1A. In particular, the first shelter support 10 forms a column support portion 30*a* of the truss 30. The second shelter support 10' forms the pitched roof support portion 30*b* of the truss 30. The first end element 16 of the first shelter support 10 is configured to horizontally contract the ground, becoming a base 32 to support the truss 30.

The outer beam 12 is at an acute angle such as about 70 degrees with respect to the base 32 and thus the ground. The inner beam 14 is at a smaller acute angle such as about 60 degrees, diverging from the outer beam 12 by about 10 degrees. The second end member 18 forms an acute angle with the horizontal, such as about 45 degrees. Thus, the second shelter support 10' has its first end member 16' vertically disposed, forming an apex 34 for the truss 30.

A shoulder joint 36 between shelter supports 10, 10' advantageously provides sufficient contact area for transferring loads between the roof support portion 30*b* and the column support portion 30*a*. Two bolts 38 attach the two supports 10, 10' to complete the shoulder joint 36, allowing for simple assembly and disassembly with typical hand tools. Holes 39 are provided in the end members 16, 18 to facilitate the connections between supports 10. Alternatively, interlocking engagement mechanisms and/or adhesives may be used to form the joint 36. The components of the shelter supports and trusses can be manufactured from wood, extruded thermoplastics, resins, PVC, metal or a wide range of other appropriate materials.

FIG. 2 is a perspective view of a first shelter 50 that has an elongate shape by the inclusion of central horizontal beam 52 at the apex portion. One end 52*a* of the beam 52 is joined to the apex of three trusses 54–56. Each truss 54–56 is outwardly placed in a hemisphere from the end 52*a* and angularly spaced from the other trusses 54–56. Three other trusses 57–59 are coupled to the other end 52*b* of the beam 52. The shelter frame 60 formed from the beam 52 and trusses 54–59 is suitable for receiving a roof covering 62. The roof covering 62 may be a fabric such as coated vinyl, plastic, or more rigid monolithic or multi-component assemblies such as shingles or the like.

Figure 3A:
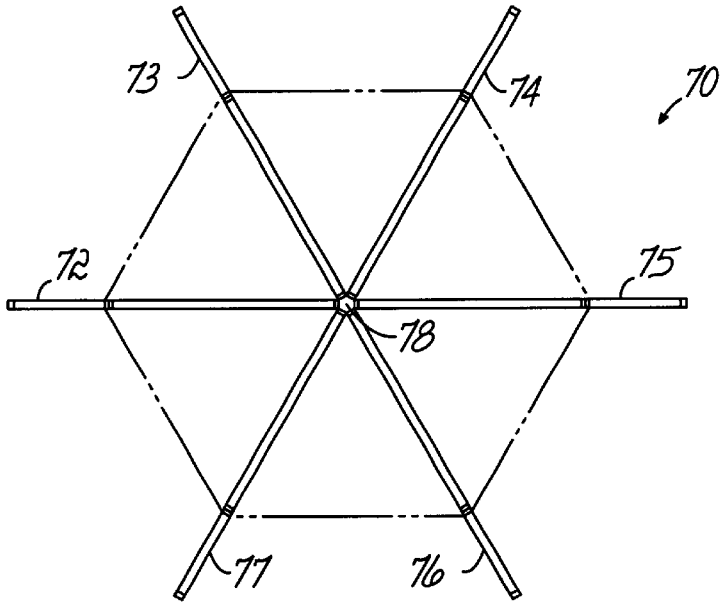
FIG. 3A is an overhead plan view of a second shelter formed from six shelter trusses of FIG. 1C arrayed about a central point.
Figure 3B:
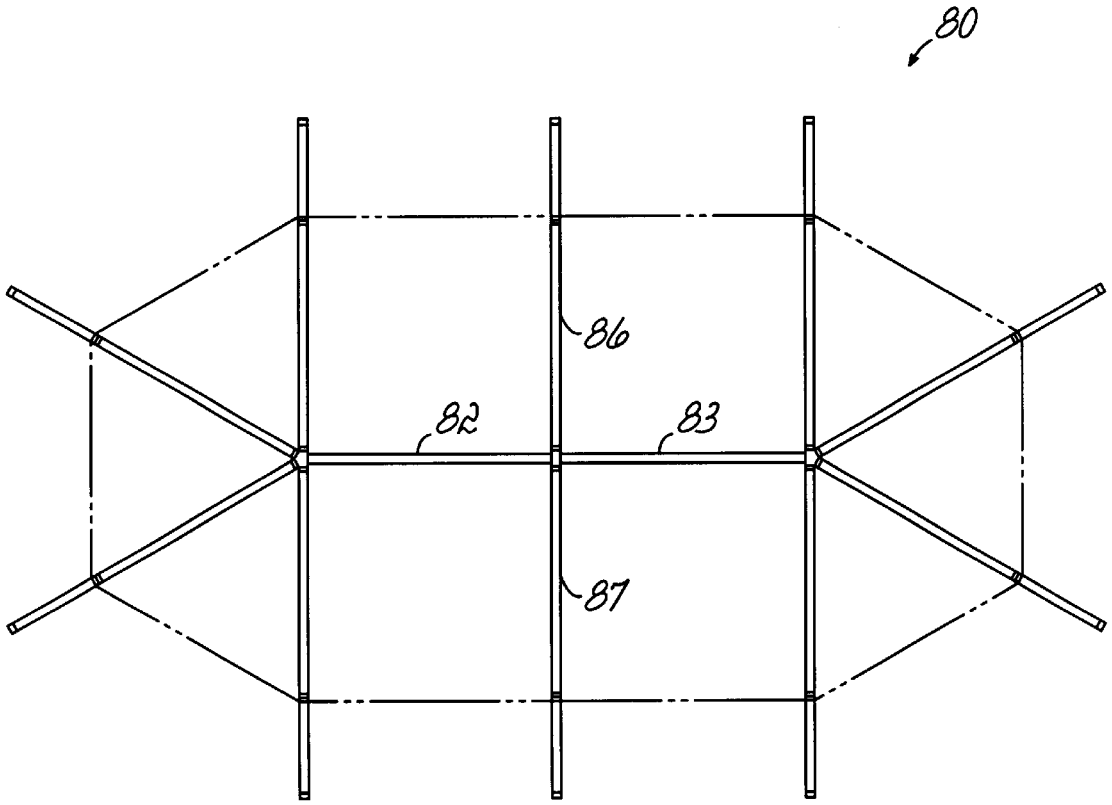
FIG. 3B is an overhead plan view of a third shelter formed from ten shelter trusses of FIG. 1C arrayed about two aligned central horizontal beams.
Figure 3C:
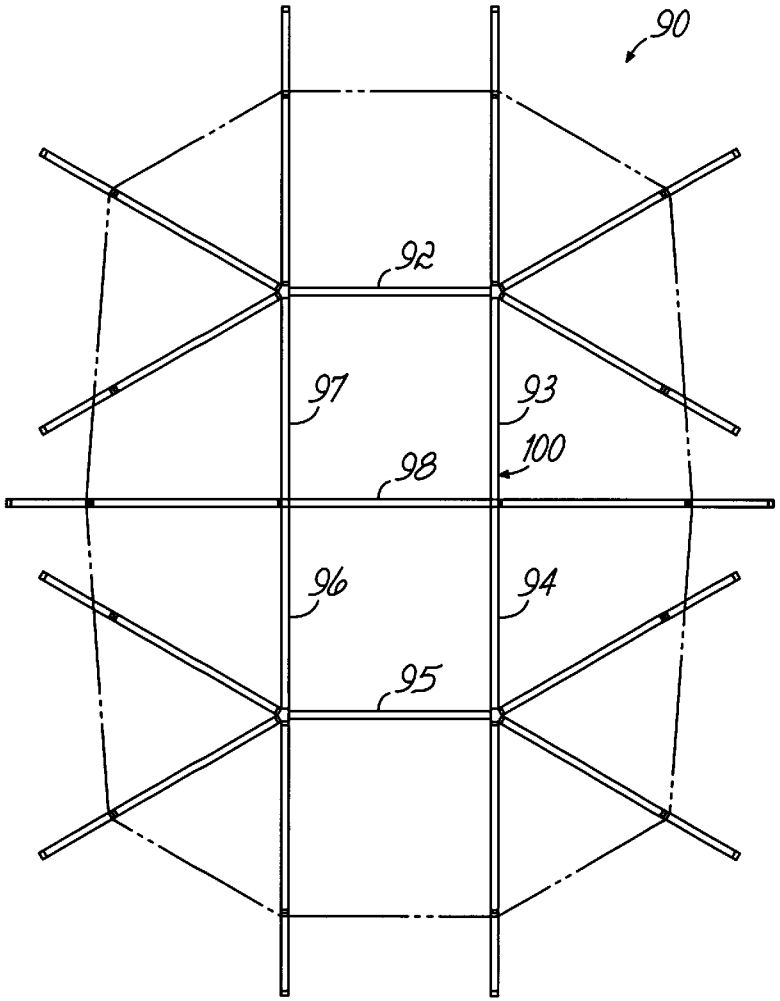
FIG. 3C is an overhead plan view of a fourth shelter formed from fourteen shelter trusses of FIG. 1C arrayed about a rectangular central horizontal frame.

Referring to FIGS. 3A–3C, additional examples of shelters of various shapes illustrate the flexibility afforded by the shelter support 10. Referring to FIG. 3A, a second shelter 70 is formed from a plurality of trusses 72–77 angularly spaced about a central point 78 at the apex portion without any central beam 52. Thus, the shelter 70 may be substantially round.

Referring to FIG. 3B, a third shelter 80 illustrates further elongating the shape with two aligned central horizontal beams 82, 83, supported at their combined midpoint by two trusses 86–87 placed in opposition to one another and perpendicular to the beams 82, 83. The outward ends of the two beams 82, 83 are each supported by four trusses placed in hemispheric outward relation.

Referring to FIG. 3C, a fourth shelter 90 illustrates increasing the area of the shelter in both length and width with the same truss and beam dimensions. Seven beams 92–98 form a central horizontal polygon frame 100 at the apex portion. In particular, the frame 100 is a rectangularly configuration having two beams along the length, one beam across each end, and one between the midpoint of the two long sides. Each corner of the frame 100 is supported by three outwardly placed trusses.

Figure 4:
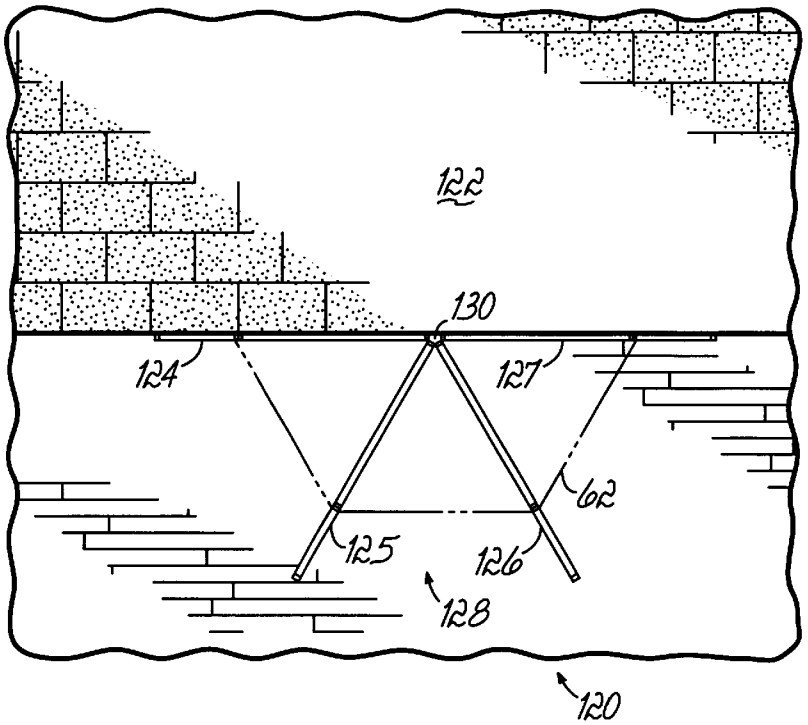

Referring to FIG. 4, additional flexibility of the shelter support 10 is illustrated by providing an attached shelter 120 against a building 122. In particular, four angularly spaced trusses 124–127 form a hemispheric frame 128 with its apex 130 adjacent to the building 122. The hemispheric frame 128 of attached shelter 120 supports a flat pitched shelter roof 62 by direct contact to roof support portions 125*b,* 126*b* of trusses 125, 126. Trusses 124, 127 are juxtaposed to the building 122, which is shown as planar, but may be another shape or configuration for use with shelter 120.

Advantageously, the shelter support 10 may incorporate provisions for utilities, such as electrical power conduits, electrical lighting conduits, natural gas conduits, and/or telecommunication and entertainment signal conduits. Thus, unattractive and unsafe external conduits are avoided, as well as the expense of professional installation within the shelter structure.

Referring to FIG. 5, the inner beam 14 of a shelter support 10 has an I-shaped cross section at line 5—5 of FIG.1C. Thus, longitudinal recesses 140, 142 may receive a plurality of utility conduits 144 that are covered by selectively removable utility panels 146, 148.

In summary, a first shelter support 10 may be joined to a second shelter support 10' at their respective second end members 18, 18' to 5 form a truss. The process may be repeated to form a plurality of trusses. With several trusses angularly spaced in circle and joined at their respective apexes, a substantially round shelter 70 may be formed. Alternatively, by arranging several trusses about each end of a central horizontal beam 52, an elongated shelter 50 may be formed. As a further alternative, two aligned and joined beams 82, 83 may be supported in a similar fashion with additional trusses perpendicular to the joined midpoint of the two beams 82, 83. As yet further alternative, various combinations of beams may be formed in a horizontal polygon shape whose corners are then supported by trusses.

Other modifications will be apparent to one of ordinary skill in the art. For example, the shelter supports and trusses can be arranged in a wide variety of configurations and used in a vast range of applications in addition to those disclosed herein. Therefore, the invention lies in the claims hereinafter appended and equivalents thereof.

What is claimed is:

1. A truss adapted for use in constructing a shelter formed from a plurality of identical trusses, the truss comprising:

a pair of identical first and second shelter supports, each shelter support further comprising:

a) an elongate outer beam member;

b) an elongate inner beam member placed in angularly divergent relationship to the outer beam member;

c) a plurality of spaced lateral supports extending between the inner and outer beams;

d) a first end member capping respective converging ends of the outer and inner beam members; and e) a second end member capping respective diverging ends of the outer and inner beam members;

wherein the second end member of each shelter support is coupled to the other shelter support to form the truss, and wherein at least one of the beam members includes a longitudinal recess adapted to receive a utility conduit.

2. The truss of claim 1, wherein the second end member of each shelter support is configured to form approximately a 45 degree angle with respect to the associated first end member.

3. The truss of claim 1, wherein the outer beam member of each shelter support extends from the first end member at about 70 degrees and the inner beam member extends from the first end member at about 60 degrees, both with respect to the first end member.

4. The truss of claim 1, wherein the second end member of each shelter support forms an acute angle with the associated elongate outer beam member and an obtuse angle with the associated elongate inner beam member so that the truss is adapted to simultaneously provide column support and roof support for a shelter.

5. A shelter support comprising:

an elongate outer beam member;

an elongate inner beam member placed in angularly divergent relationship to the outer beam member;

a plurality of spaced lateral supports extending between the inner and outer beams;

a first end member capping respective converging ends of the outer and inner beam members; and a second end member capping respective diverging ends of the outer and inner beam members; the second end member configured for abutting engagement to another second end member of an identical second shelter support to form a truss;

wherein at least one of the beam members includes a longitudinal recess adapted to receive a utility conduit.

6. The shelter structure of claim 5, wherein at least one beam member further includes a longitudinal recess cover closing the longitudinal recess.

7. A shelter comprising:

a plurality of trusses outwardly aligned to an apex portion, each truss formed from identical first and second shelter supports;

each shelter support comprising:

an elongate outer beam member;

an elongate inner beam member placed in angularly divergent relationship to the outer beam member;

a first end member capping respective converging ends of the outer and inner beam members; and a second end member capping respective diverging ends of the outer and inner beam members, the second end member being in abutting engagement and coupled to another second end member of an identical second shelter support.

8. The shelter of claim 7, wherein the apex portion comprises a central point.

9. A shelter comprising:

an apex portion comprising a central generally horizontal beam;

a plurality of trusses arrayed in hemispheric angularly spaced relation to each end of the central generally horizontal beam, each truss formed from identical first and second shelter supports;

each shelter support comprising:

an elongate outer beam member;

an elongate inner beam member placed in angularly divergent relationship to the outer beam member;

a first end member capping respective converging ends of the outer and inner beam members; and a second end member capping respective diverging ends of the outer and inner beam members, the second end member being in abutting engagement and coupled to another second end member of an identical second shelter support.

10. A shelter comprising:

a apex portion comprising a central generally horizontal polygon; and a plurality of trusses outwardly arrayed in angularly spaced relation to each other at each corner of the central generally horizontal polygon, each truss formed from identical first and second shelter supports;

each shelter support comprising:

an elongate outer beam member;

an elongate inner beam member placed in angularly divergent relationship to the outer beam member;

a first end member capping respective converging ends of the outer and inner beam members; and a second end member capping respective diverging ends of the outer and inner beam members, the second end member being in abutting engagement and coupled to another second end member of an identical second shelter support.

11. A method of assembling a shelter with a plurality of identical shelter supports each comprised of an elongate outer beam member, an elongate inner beam member placed in angularly divergent relationship to the outer beam member, a first end member capping respective converging ends of the outer and inner beam members, and a second end member capping respective diverging ends of the outer and inner beam members, the method comprising:

assembling a plurality of trusses by coupling pairs of the shelter supports and placing the respective second end members of the pair in abutting engagement, wherein a roof support of each truss is formed by one of the pair and a column support formed by the other of the pair of shelter supports; and operatively coupling the first end members of the roof support of the plurality of trusses to form an apex of the shelter.

12. The method of claim 11, wherein the trusses are operatively coupled in angularly spaced relation the first end members of the roof support portion of the plurality of trusses is by placing the trusses in hemispheric relation to one another.

13. The method of claim 11, further comprising:

abutting the apex of the trusses against a building.

14. The method of claim 11, further comprising:

forming first and second sets of trusses; and coupling each apex of the first and second sets of trusses together with a central beam arrangement.

15. The method of claim 14, wherein the central beam arrangement is a polygonal structure.

16. The shelter structure of claim 5, further comprising an electrical conduit attachably received within the longitudinal recess.

17. The shelter of claim 7, wherein at least one beam member further includes a longitudinal recess cover closing the longitudinal recess.

18. The shelter of claim 17, further comprising an electrical conduit attachably received within the longitudinal recess.

19. The shelter of claim 17, wherein at least one beam member further includes a longitudinal recess cover closing the longitudinal recess.

* * * * *